US007005594B2

(12) United States Patent
Kim

(10) Patent No.: US 7,005,594 B2
(45) Date of Patent: Feb. 28, 2006

(54) MOVABLE CONTACTOR ASSEMBLY OF CIRCUIT BREAKER

(75) Inventor: Yong-Gi Kim, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 11/103,443

(22) Filed: Apr. 12, 2005

(65) Prior Publication Data

US 2005/0231308 A1 Oct. 20, 2005

(30) Foreign Application Priority Data

Apr. 16, 2004 (KR) ..... 10-2004-0026372
Apr. 16, 2004 (KR) ..... 10-2004-0026373

(51) Int. Cl.
*H01H 3/00* (2006.01)

(52) U.S. Cl. ..... 200/244; 218/22; 335/16

(58) Field of Classification Search ..... 200/244, 200/288, 248; 218/22, 30–32; 335/16, 46, 335/193, 147, 195
See application file for complete search history.

(56) References Cited

U.S. PATENT DOCUMENTS 4,910,485 A * 3/1990 Bolongeat-Mobleu et al. ... 335/195
5,310,971 A * 5/1994 Vial et al. ..... 200/244
6,259,048 B1 * 7/2001 Castonguay et al. ..... 200/244
6,262,642 B1 * 7/2001 Bauer ..... 335/16
6,310,307 B1 * 10/2001 Ciarcia et al. ..... 200/244
6,326,868 B1 * 12/2001 Kranz et al. ..... 335/8
6,403,909 B1 * 6/2002 Green et al. ..... 218/22

* cited by examiner

*Primary Examiner*—Michael A. Friedhofer
(74) *Attorney, Agent, or Firm*—Greenblum & Bernstein, P.L.C.

(57) ABSTRACT

Disclosed is a movable contactor assembly of a circuit breaker capable of enhancing a current limiting function by maintaining a contact state between a movable contactor and fixed contactors in a closed circuit state, by preventing the separated movable contactor from returning towards the fixed contactors at the time of a current limiting operation, by accelerating a separation operation of the movable contactor from the fixed contactors at the time of a current limiting operation, and by continuously maintaining a separated state of the movable contactor from the fixed contactors until a trip operation is performed by a trip mechanism.

7 Claims, 9 Drawing Sheets

MOVABLE CONTACTOR ASSEMBLY OF CIRCUIT BREAKER

BACKGROUND OF THE INVENTION

1. Field of the Invention

The present invention relates to a movable contactor assembly for a circuit breaker, and more particularly, to a movable contactor assembly for a circuit breaker capable of enhancing a current limiting performance by improving an assembly of a movable contactor and a rotation shaft for supporting the movable contactor.

2. Description of the Conventional Art

Generally, a circuit breaker is installed at an electric power distributing board among several electric power systems of a factory and a building. The circuit breaker serves as a switch for supplying or cutting off power to a load side under no load state, and cuts off power supplied to a load side from a power side in order to protect a circuit and components of the load side when a great abnormal current due to a short-circuit or a ground fault flows on a circuit under a load state.

FIG. 1 is a sectional view showing an inner construction of a circuit breaker in accordance with the conventional art, and FIG. 2 is a frontal view of a movable contactor assembly of the circuit breaker in accordance with the conventional art, which shows a closed circuit state, and FIG. 3 is a frontal view of the movable contactor assembly of the circuit breaker in accordance with the conventional art, which shows an opened circuit state.

As shown, a circuit breaker 1 comprises a mold case 10, fixed contactors 20 and 30 installed in the mold case 10 with a predetermined distance, a movable contactor assembly 40 disposed between the fixed contactors 20 and 30, a trip mechanism 50 for tripping the circuit breaker by detecting a large current, a switching mechanism 60 automatically operated by the trip mechanism 50 or manually operated by operating a switching handle 11, for separating a movable contactor 41 from the fixed contactors 20 and 30 thereby cutting off a circuit, and an arc extinguishing mechanism 70 for extinguishing arc gas of a high temperature and a high pressure generated between contacts 41*a* and 41*b* of the movable contactor 41 and contacts 21 and 31 of the fixed contacts 20 and 30 at the time of switching a circuit.

The mold case 10 is provided with the above mechanisms therein, and is formed of an insulating material to insulate the mechanisms of phases, and to prevent foreign materials such as dust from being introduced into the mold case 10.

The fixed contactors, that is, a power side fixed contactor 20 and a load side fixed contactor 30 are respectively provided with a contact 21 and a contact 31 at the end thereof. The movable contactor 41 is provided with a contact 41*b* at both ends thereof.

The movable contactor assembly 40 comprises a movable contactor 41 rotatably positioned between the fixed contactors 20 and 30 for maintaining a closed state or an opened state, a rotation shaft 43 disposed between the fixed contacts 20 and 30 for supporting the movable contactor 41, and a pair of springs 45 and 47 respectively having one ends 45*a* and 47*a* fixed to the movable contactor 41 and the other ends 45*b* and 47*b* fixed to the rotation shaft 43 for elastically rotating the movable contactor 41 centering around a virtual rotation axis 43*a* by an electromagnetic repulsive force generated at the contacts 21, 41*b*, 31 when a large-current flows on a circuit due to a short-circuit or a ground fault. The method for supporting the movable contactor 41 to the rotation shaft 43 centering around the virtual rotation shaft 43*a* is called as a self centering.

As shown in FIG. 2, a state that the contact 41*b* of the movable contactor 41 is in contact with the contact 21 and 31 of the fixed contactors 20 and 30 is called as 'a closed circuit state'. As shown in FIG. 3, a state that the contact 41*b* of the movable contactor 41 is separated from the contacts 21 and 31 of the fixed contactors 20 and 30 is called as 'an opened circuit state'. Also, converting the closed circuit state to the opened circuit state is called as 'separating and opening'.

The movable contactor 41 is supported by the pair of springs 45 and 47 disposed to be symmetrical to each other centering around the virtual rotation axis 43*a*.

One ends 45*a* and 47*a* of the springs 45 and 47 are fixed to the movable contactor 41, and another ends 45*b* and 47*b* thereof are fixed to the rotation shaft 43. Accordingly, as shown in FIG. 2, when a normal current flows on a circuit, the contact 41*a* and 41*b* of the movable contactor 41 is in contact with the contacts 21 and 31 of the fixed contactors 20 and 30 thereby to maintain a closed circuit state. Under the state, the springs 45 and 47 provide an elastic force to the movable contactor 41 so that the movable contactor 41 can be maintained in contact with the fixed contactors 20 and 30. Accordingly, an electric current flows from the power side fixed contactor to the load side fixed contactor 30, 20 through the movable contactor 41.

As shown in FIG. 3, when a large current flows on a circuit due to a short-circuit or a ground fault, the movable contactor 41 is separated from the fixed contactors 20 and 30 by an electromagnetic repulsive force between the contacts 41*a* and 41*b* of the movable contactor 41 and the contacts 21 and 31 of the fixed contactors 20 and 30 thereby to have a rotation moment. Accordingly, the movable contactor 41 overcomes an elastic force of the springs 45 and 47, and rotates in a clockwise direction thereby to cut off the circuit. An unexplained reference numeral 49 designates a stopper for limiting a rotation range of the movable contactor.

The conventional movable contactor assembly of a circuit breaker has the following problems. When the movable contactor 41 is separated from the fixed contactors 20 and 30, the virtual rotation axis 43*a* of the movable contactor 41 is not stable, so it cause to generate a fluctuation of the movable contactor 41 in right and left directions and up and down directions. Also, when the movable contactor 41 is separated from the fixed contactors 20 and 30, an elastic restoration force of the springs 45 and 47 increases and thereby the movable contactor 41 becomes in contact with the fixed contactors 20 and 30 again due to the restoration force. That causes a re-contact between the contacts at the time of a short-circuit and a re-separation therebetween by an electromagnetic repulsive force, thereby continuously generating an arc. Accordingly, an instant current limiting characteristic is not obtained and severe damages may be caused to the circuit breaker and the load devices.

SUMMARY OF THE INVENTION

Therefore, an object of the present invention is to provide a movable contactor assembly of a circuit breaker capable of effectively preventing a movable contactor separated from a fixed contactor from returning to a contact state to the fixed contactors, and capable of accelerating a separation of the movable contactor from the fixed contactors in an opened circuit state.

Another object of the present invention is to provide a movable contactor assembly of a circuit breaker capable of maintaining a separated state of a movable contactor from a fixed contactor until a trip operation is performed by a trip mechanism.

Still another object of the present invention is to provide a movable contactor assembly of a circuit breaker capable of stably maintaining a contacted state between contacts of fixed contactors and a contact of a movable contactor in a closed circuit state.

Yet another object of the present invention is to provide a movable contactor assembly of a circuit breaker capable of concentrically constructing a rotation shaft and a movable contactor even if a rotation axis is not installed, and capable of preventing the rotating movable contactor from being interfered with a spring even if a rotation axis is installed at the time of a current limiting operation.

Yet still another object of the present invention is to provide a movable contactor assembly of a circuit breaker capable of simply and fast assembling a spring to a rotation shaft by installing the spring at both lateral surfaces of the rotation shaft.

Yet still other object of the present invention is to provide a movable contactor assembly of a circuit breaker capable of uniformly maintaining a contact pressure between a movable contactor and fixed contactor by forming a rotation axis hole for passing a rotation axis at a movable contactor as a vertical long hole even if upper and lower fixed contactors are not precisely symmetrical to the movable contactor.

To achieve these and other advantages and in accordance with the purpose of the present invention, as embodied and broadly described herein, there is provided a movable contactor assembly of a circuit breaker comprising:

a rotation shaft provided with an opening for allowing independent rotating of a movable contactor at the time of a current limiting operation and having a cam surface on an outer circumferential surface thereof, for rotatably supporting the movable contactor;

the movable contactor rotatably supported by the rotation shaft, symmetrically having a pair of contacts at both ends thereof and a pair of linear motion guiding grooves, and rotatable to a contacted position to fixed contactors or a separated position from the fixed contactors;

a pair of slide pins disposed across both lateral surfaces of the rotation shaft, linearly movable in the linear motion guiding grooves, and maintaining a contact state to the cam surface of the rotation shaft under a state that the movable contactor is in contact with the fixed contactors, for providing a pressure to the movable contactor in a direction to accelerate a separation of the movable contactor from the fixed contactors with being separated from the cam surface and thereby being slid along an outer circumferential surface of the rotation shaft at the time of a current limiting operation that the movable contactor is separated from the fixed contactors to be rotated; and a spring for providing an elastic force to the slide pins so that a contact between the movable contactor and the fixed contactors can be maintained under a state that the movable contactor is in contact with the fixed contactors, and for providing an elastic force to the slide pins in a direction to accelerate a separation of the movable contactor from the fixed contactors at the time of a current limiting operation that the movable contactor is separated and rotated from the fixed contactors in contrast to the static rotation shaft.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
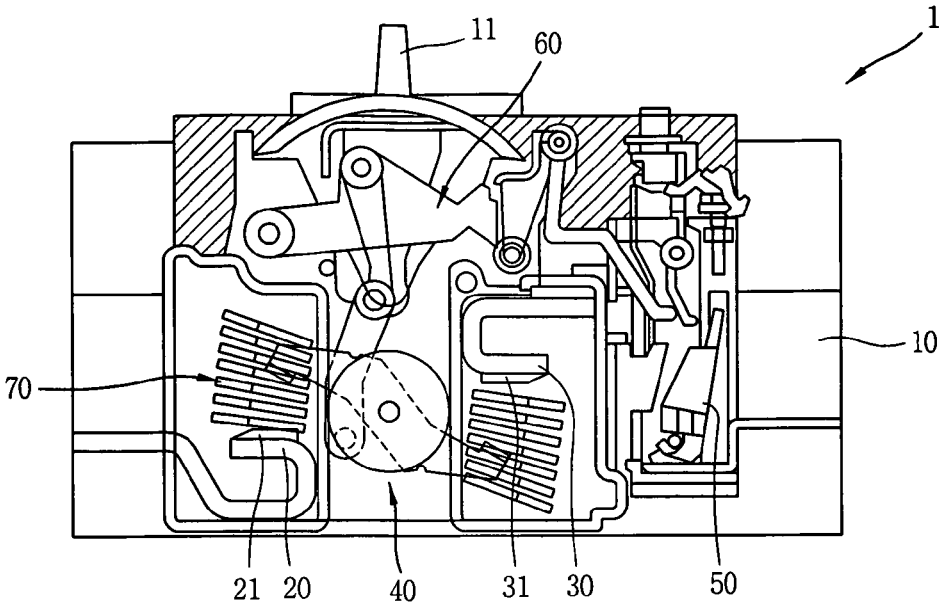
FIG. 1 CONVENTIONAL ART
FIG. 1 is a sectional view showing an inner construction for a circuit breaker in accordance with the conventional art.

Reference will now be made in detail to the preferred embodiments of the present invention, examples of which are illustrated in the accompanying drawings.

Hereinafter, a movable contactor assembly of a circuit breaker according to the present invention will be explained as follows with reference to FIGS. 4 to 9.

As shown, a movable contactor assembly 100 of a circuit breaker according to the present invention comprises: a rotation shaft 110 having an opening 111 for independent rotating of a movable contactor 120 at the time of a current limiting operation and having a cam surface 113 on an outer circumferential surface thereof, for rotatably supporting the movable contactor 120; a movable contactor 120 rotatably supported by the rotation shaft 110, symmetrically having a pair of contacts 121 at both ends thereof and a pair of linear motion guiding grooves 123, and disposed to be rotated to a contacted position to fixed contactors 20 and 30 and a separation position from the fixed contactors 20 and 30; a pair of slide pins 131 disposed across both lateral surfaces of the rotation shaft 110, linearly movable in the linear motion guiding grooves 123, and maintaining a contact state to the cam surface 113 of the rotation shaft 110 under a state that the movable contactor 120 is in contact with the fixed contactors 20 and 30, for providing a pressure to the movable contactor 120 in a direction to accelerate a separation of the movable contactor 120 from the fixed contactors 20 and 30 with being separated from the cam surface 113 and thereby being slid along an outer circumferential surface of the rotation shaft 110 at the time of a current limiting operation that the movable contactor 120 is separated from the fixed contactors 20 and 30 to be rotated; and springs 141 and 142 for providing an elastic force to the slide pins 131 so that a contact between the movable contactor 120 and the fixed contactors 20 and 30 can be maintained under a state that the movable contactor 120 is in contact with the fixed contactors 20 and 30, and for providing an elastic force to the slide pins 131 in a direction to accelerate a separation of the movable contactor 120 from the fixed contactors 20 and 30 at the time of a current limiting operation that the movable contactor 120 is separated from the fixed contactors 20 and 30 to be rotated.

Figure 4:
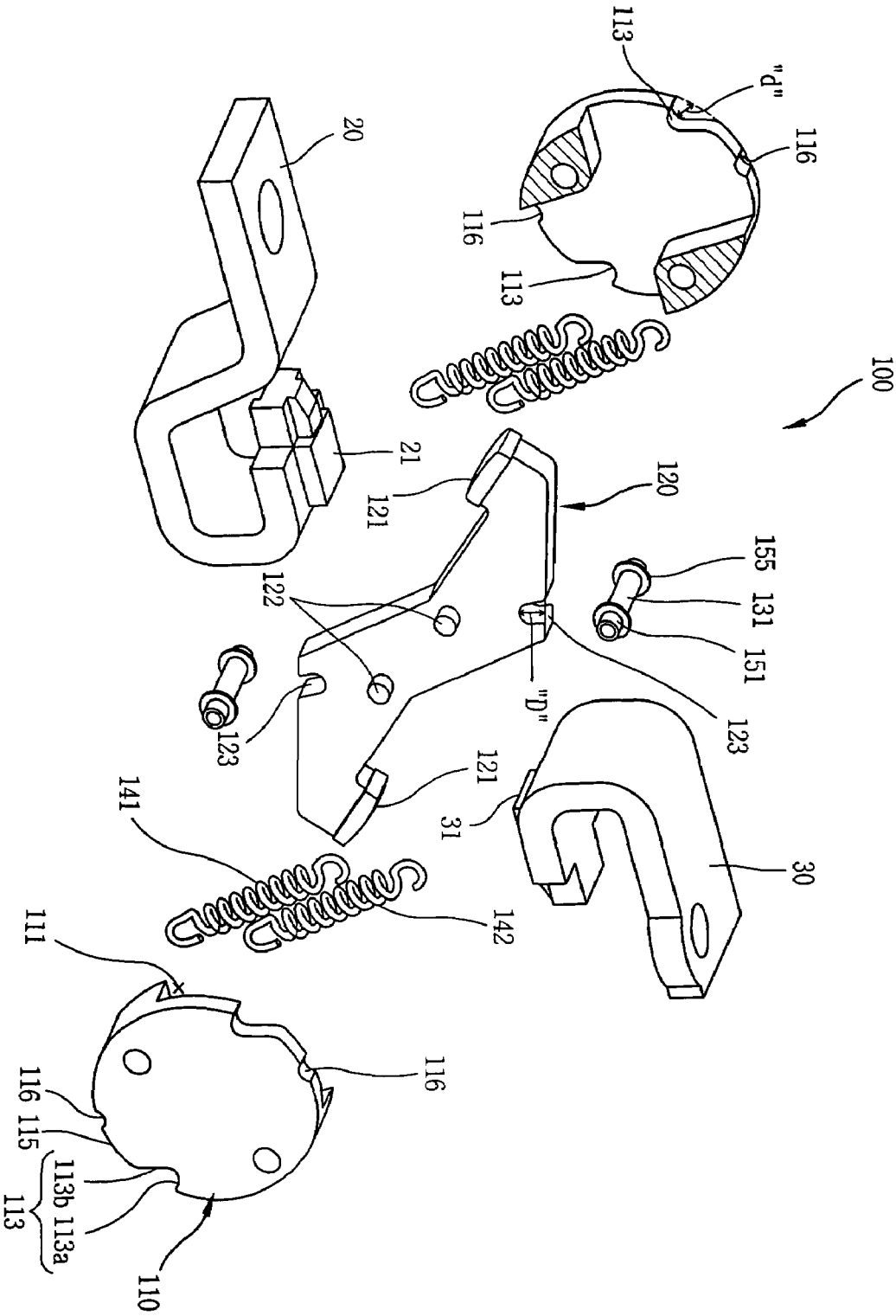
FIG. 4 is an exploded view showing an appearance of a movable contactor assembly for a circuit breaker according to a first embodiment of the present invention.
Figure 5:
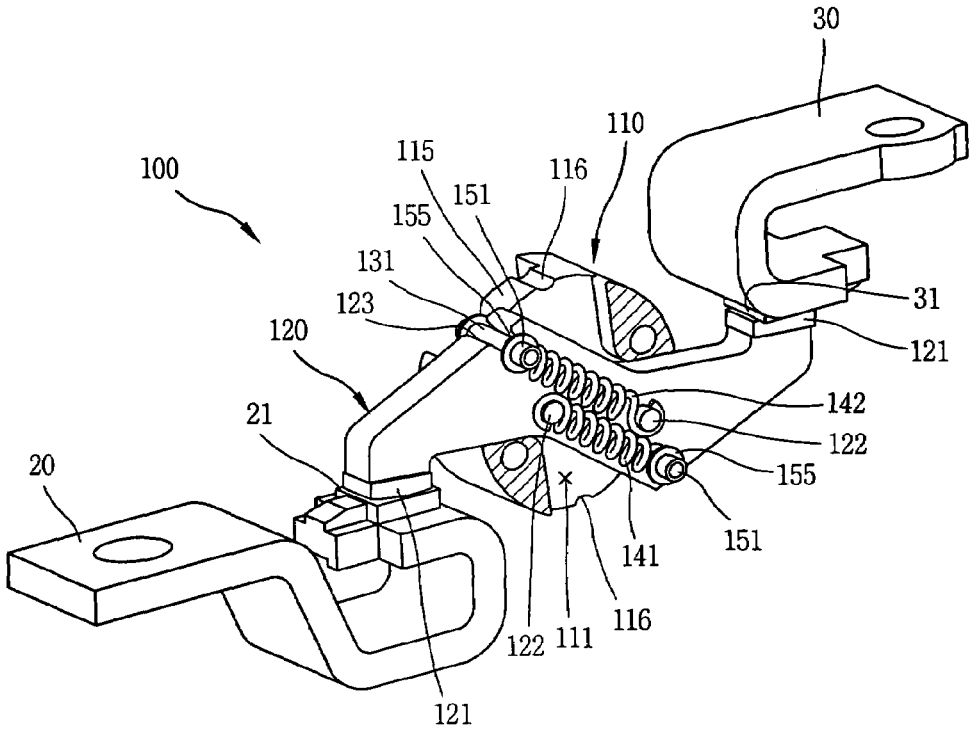
FIG. 5 is a perspective view of the movable contactor assembly for a circuit breaker according to the first embodiment of the present invention, which shows a state that contacts are in contact with each other (a closed circuit state)

More specifically, the movable contactor 120 is disposed between a power side fixed contactor 20 (left one of FIG. 4) and a load side fixed contactor 30 (right one of FIG. 4). The fixed contactors 20 and 30 are current limiting type fixed contactors having end portions to which contacts 21 and 31 are attached, the end portions respectively bent towards a power terminal to which a power source side line is connected or a load terminal to which a load side line is connected. The movable contactor 120 has a symmetrical shape on the basis of the center in a longitudinal direction, and is provided with each contact 121 at both ends thereof thereby to be called as a double contacts type.

The two openings 111 of the rotation shaft 110 formed by perforating through the rotation shaft 110 in direction of diameter at a predetermined angle so that both ends of the movable contactor 120 in a longitudinal direction can be freely rotated in the openings 111.

As shown in FIG. 4, the rotation shaft 110 is a cylindrical shaft formed as two pieces of shaft are combined to each other, and a pair of cam surfaces 113 of the rotation shaft 110 are symmetrical to each other on an outer circumferential surface of the rotation shaft 110.

The cam surface 113 on the outer circumferential surface of the rotation shaft 110 is the surface for receiving the slide pins 131 and includes a first arc surface 113*a* having a predetermined first radius from a center out of the rotation shaft 110 for mounting the slide pins 131 at a contacted position of the movable contactor 120 to the fixed contacts 20 and 30, and a second arc surface 113*b* having a predetermined second radius formed from a center in the rotation shaft 110 and longer than the first radius. The cam surface 113 may be modified to include a plurality of arc surfaces having a plurality of radiuses formed from inner or external centers of the rotation shaft 110.

The slide pins 131 across the lateral surfaces of the rotation shaft 110 to be installed in the linear motion guiding grooves 123. At the time of a current limiting operation, the slide pins 131 sequentially pass through the first arc surface 113*a* and the second arc surface 113*b* of the rotation shaft 110 thereby to be slid along an outer circumferential surface 115 of the rotation shaft 110, and at the same time, are performed a linearly motion in the linear motion guiding grooves 123 of the movable contactor 120.

A depth D of the linear motion guiding groove 123 is formed to be deeper than or equal to a depth d of the cam surface in order to prevent the slide pins 131 from being separated from the linear motion guiding grooves 123.

Preferably, a pair of rollers 151 are rotatably disposed at both ends of the slide pin 131 in a longitudinal direction in order to decrease a frictional force between the slide pin 131 and the rotation shaft 110.

The rollers 151 are stopped at the first arc surface 113*a* of the cam surface 113 when the movable contactor 120 is in contact with the fixed contactors 20 and 30. Also, at the time of a current limiting operation that the movable contactor 120 is separated from the fixed contactors 20 and 30 to be rotated, the rollers 151 pass through the second arc surface 113*b* of the cam surface 113 to be slid along the outer circumferential surface 115 of the rotation shaft 110, thereby minimizing a friction between the slide pins 131 and the rotation shaft 110 and performing a smooth current limiting operation.

A pair of fixed pins 122 are formed on both lateral surfaces of the movable contactor 120 to be symmetrical to each other on the basis of a rotation center.

Two springs 141 and 142 are installed at each lateral surface of the movable contactor 120, and are symmetrically installed so that one ends thereof can be supported by the slide pins 131 and another ends thereof can be supported by the fixed pins 122.

The rotation shaft 110 is provided with a pair of holding groove surfaces 116. The holding groove surfaces 116 delay a motion of the movable contactor 120 to return to the contacted position to the fixed contactors 20 and 30 by receiving the slide pins on the outer circumferential surface of the rotation shaft 110 at a final position of the rotating movable contactor 120, or sustains a separated state of the movable contactor 120 from the fixed contactors 20 and 30 at the time of a current limiting operation.

Under a state that the movable contactor 120 is in contact with the fixed contactors 20 and 30, that is, a closed circuit state, the rollers 151 are in contact with the first arc surface 113*a* having a center out of the rotation shaft 110. Also, at the time of a current limiting operation that the movable contactor 120 is separated from the fixed contactors 20 and 30 by an electromagnetic repulsive force to be rotated due to the large current on a circuit, that is, when the contacts are separated from each other, the rollers 151 are sequentially moved to the first arc surface 113*a* and to the second arc surface 113*b* having a second radius formed from said center in the rotation shaft 110 and longer than the first radius of the first arc surface 113*a*, and roll on the outer circumferential surface 115 of the rotation shaft 110. The springs 141 and 142 provide an elastic force to the movable contactor 120 as a rotation moment through the slide pins 131 so that the separation of the movable contactor 120 from the fixed contactors 20 and 30 can be accelerated.

An unexplained reference numeral 155 denotes a washer serving as a spacer between the rollers 151 and an outer surface of the movable contactor 120 for preventing an interruption of the rollers 151 due to a friction between the rollers 151 and the outer surface of the movable contactor 120.

Figure 6:
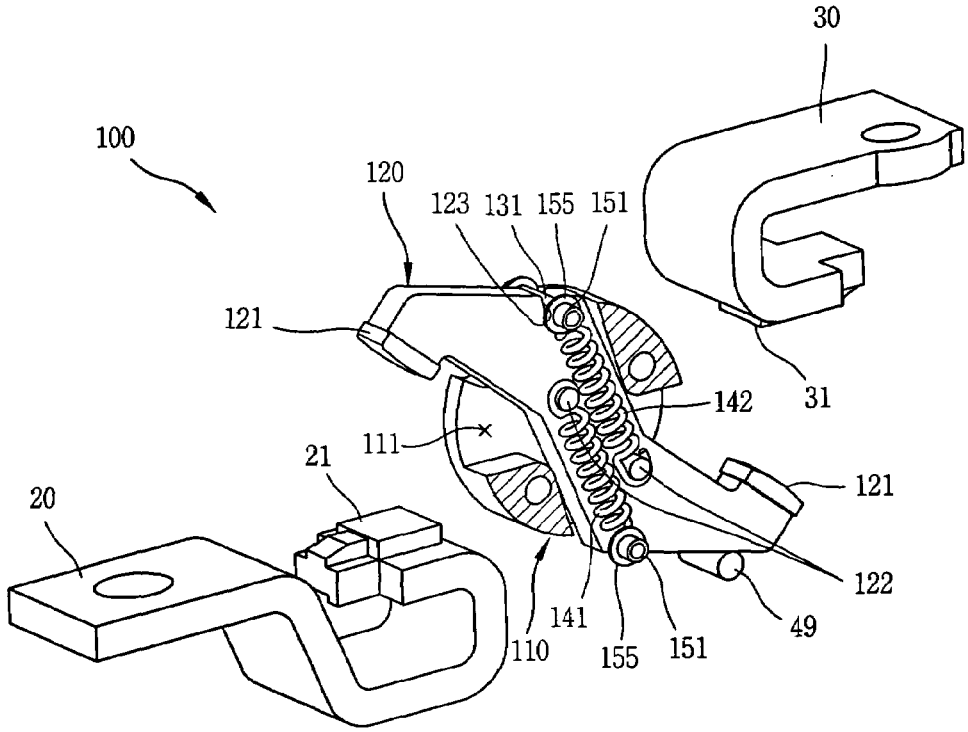
FIG. 6 is a perspective view of the movable contactor assembly for a circuit breaker according to the first embodiment of the present invention, which shows a state that the contacts are separated from each other (an opened circuit state)

An unexplained reference numeral 49 of FIG. 6 denotes a stopper, a limit pin for limiting a rotation position of the movable contactor 120 into a preset position when the movable contactor 120 is separated from the fixed contactors 20 and 30.

The movable contactor assembly of one phase was disclosed for the convenience of explanation. However, in case of a multiple-phase movable contactor assembly, the rotation shaft 110 can have a bar shape long connected to a rotation shaft of another phase and be connected to the switching mechanism 12 of FIG. 1, so that rotation shafts of several phases can be simultaneously rotated by the switching mechanism 12.

Figure 2:
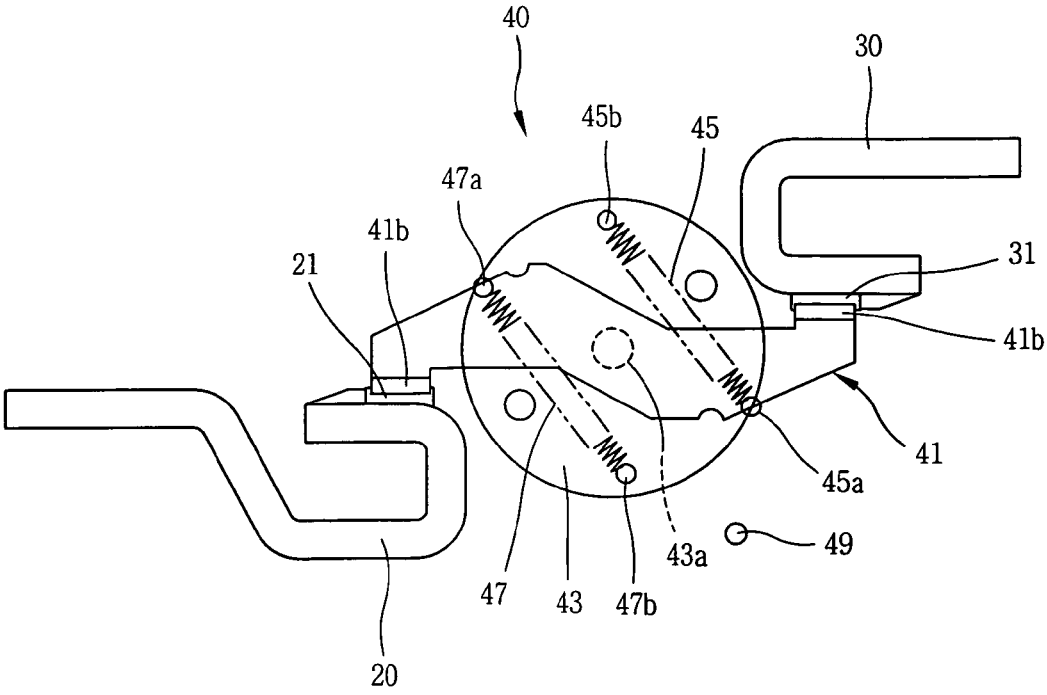
FIG. 2 CONVENTIONAL ART
FIG. 2 is a frontal view of a movable contactor assembly for the circuit breaker in accordance with the conventional art, which shows a state that contacts are in contact with each other (a closed circuit state)
Figure 3:
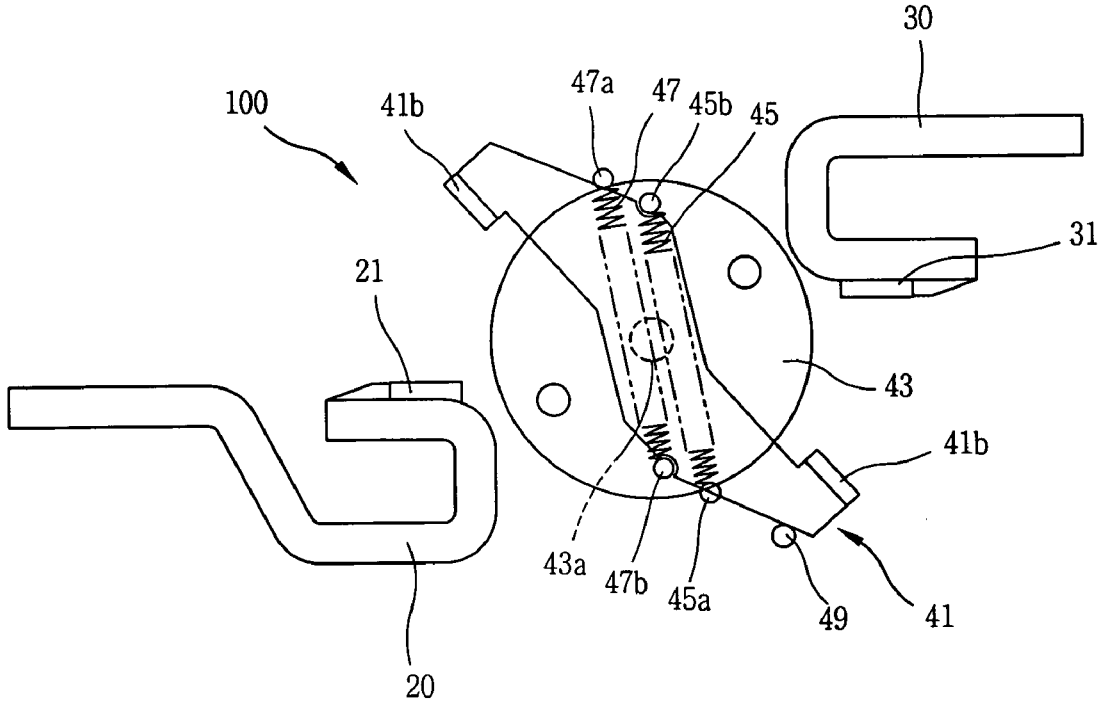
FIG. 3 CONVENTIONAL ART
FIG. 3 is a frontal view of the movable contactor assembly for the circuit breaker in accordance with the conventional art, which shows a state that contacts are separated from each other (an opened circuit state)

The movable contactor 120 of the aforementioned embodiment is supported by a self centering by the springs 141 and 142 and the pins 131 for supporting both ends of the springs 141 and 142 without a center axis of the rotation shaft 110. However, both ends of the movable contactor 120 of the present invention can be supported by the rotation shaft 110 by penetrating a center axis into a center point of the movable contactor 120 in the longitudinal direction. In this modified embodiment, differently from the conventional art of FIGS. 2 and 3, the center axis is not interfered with the springs when the movable contactor 120 is separated from the fixed contactors 20 and 30 during a current limiting operation. The reason is as follows. In the conventional art, two movable pins 45*a* and 47*a* are clockwise moved along an upper surface of the movable contactor 120, and at the same time, are moved in a radial direction of the two pins 45*b* and 47*b* for fixing another ends of the springs 45 and 47. Accordingly, the spring is also moved in the radial direction thereby to generate an interference with the center axis. However, in the present invention, when the movable contactor 120 is separated from the fixed contactors 20 and 30 during a current limiting operation, the movable slide pins 131 performs only a linear motion in the linear motion guiding grooves 123 under a state that the spring 141 is in parallel with the spring 142 thereby not to generate an interference between the springs 141 and 142 and the center axis.

An operation of the movable contactor assembly of a circuit breaker according to the first embodiment of the present invention will be explained as follows with reference to FIGS. 7 to 9.

Figure 7:
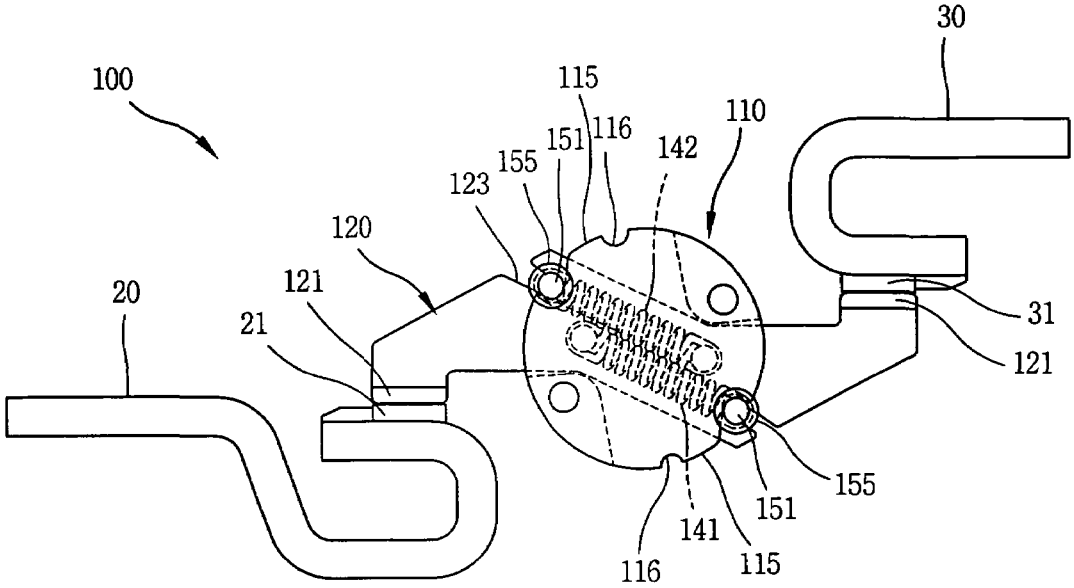
FIG. 7 is a front view of the movable contactor assembly for a circuit breaker according to the first embodiment of the present invention, which shows a state that the contacts are in contact with each other (a closed circuit state)

FIG. 7 is a frontal view of the movable contactor assembly of a circuit breaker according to the first embodiment of the present invention, which shows a state that the contacts are in contact with each other (a closed circuit state).

As shown in FIG. 7, under the state that the contacts are in contact with each other, the slide pins 131 connected to the springs 141 and 142 generate a counterclockwise rotation moment, that is, a force to rotate the movable contactor 120 in a counterclockwise direction. Accordingly, each contact 121 of the movable contactor 120 is in contact with the contacts 21 and 31 of the fixed contactors 20 and 30.

Each roller 151 of the slide pins 131 is in contact with the first arc surface 113*a* of the cam surface 113 of the rotation shaft 110. Under the closed circuit state, a current on the circuit is applied to the contact 21 of the power side fixed contactor 20, passes through each contact 121 of the movable contactor 120, and flows to a load terminal (not shown) via the contact 31 of the load side fixed contactor 30.

Figure 8:
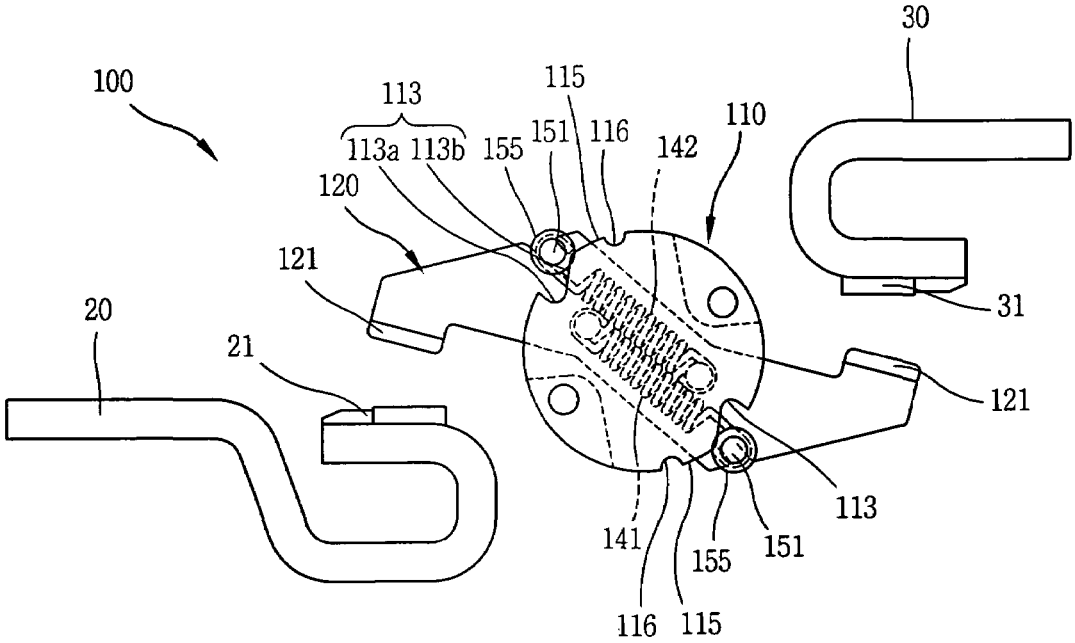
FIG. 8 is a front view of the movable contactor assembly for a circuit breaker according to the first embodiment of the present invention, which shows a state that the contacts are being separated from each other (an opened circuit state)

FIG. 8 is a frontal view of the movable contactor assembly of a circuit breaker according to the first embodiment of the present invention, which shows a state that the contacts are being in contact with each other (an opened circuit state).

As shown in FIG. 8, when the large current flows on a circuit due to a short-circuit or a ground fault, an electromagnetic repulsive force is generated between each contact 121 of the movable contactor 120 and the contacts 21 and 31 of the fixed contactors 20 and 30. Accordingly, the movable contactor 120 is rotated in a direction to be separated from the fixed contactors 20 and 30, that is, the clockwise direction. The electromagnetic repulsive force is the force much greater than the rotation moment generated by the springs 141 and 142 for rotating the movable contactor 120 counterclockwise, so that the movable contactor 120 is clockwise rotated. The rollers 151 disposed at both ends of each slide pin 131 pull the springs 141 and 142, and at the same time, roll on the second circular surface 113*b* of the cam surface 113 of the rotation shaft 110 and then are moved along the outer circumferential surface 115 of the rotation shaft 110. That is, as the movable contactor 120 is clockwise rotated, the rollers 151 disposed at both ends of each slide pin 131 pull the springs 141 and 142, and at the same time, sequentially pass the first arc surface 113*a* having the center out of the rotation shaft 110 and a starting point (so called as a dead point) of the second circular surface 113*b* having the center in the rotation shaft 110. While the rollers 151 pass through the dead point, the elastic force of the springs 141 and 142 is converted into an opened circuit rotation moment for accelerating a separation of the movable contactor from the fixed contactors from a closed circuit rotation moment for contacting the movable contactor to the fixed contactors.

The slide pins 131 are linearly moved in the linear motion guiding grooves 123, and at the same time, are slid along the cam surface 113 of the rotation shaft 110 and the outer circumferential surface 115. However, since the depth D of each linear motion guiding groove 123 is deeper than or equal to the depth d of the first circular surface 113*a*, the deepest surface among the cam surface 113, the slide pins 131 are not separated from the linear motion guiding groove 123.

Then, each roller 151 installed at the slide pins 131 is separated from the cam surface 113 of the rotation shaft 110 and rolls on the outer circumferential surface 115 by the movable contactor 120 being clockwise rotated by the electromagnetic repulsive force. The elastic force applied to the movable contactor 120 from the springs 141 and 142 through the slide pins 131 is converted into an opened circuit rotation moment for separating the movable contactor 120 from the fixed contactors 20 and 30 from a closed circuit rotation moment for returning the movable contactor 120 to the fixed contactors 20 and 30 (a counterclockwise direction in drawing), thereby accelerating the separation of the movable contactor 120 from the fixed contactors 20 and 30.

At the time of a current limiting operation by the movable contactor assembly according to the present invention, the separation of the movable contactor from the fixed contactors is accelerated thereby to improve a current limiting function of the circuit breaker.

Figure 9:
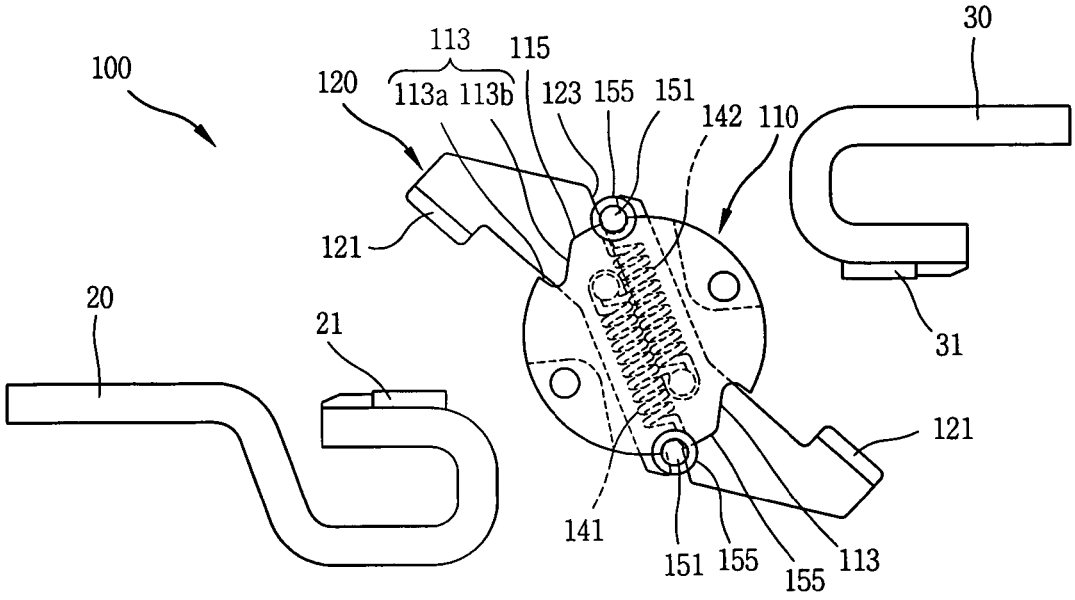
FIG. 9 is a front view of the movable contactor assembly for a circuit breaker according to the first embodiment of the present invention, which shows that the separation of the movable contactor from the fixed contactors is completed and the opened circuit state is maintained.

FIG. 9 is a front view of the movable contactor assembly for a circuit breaker according to the first embodiment of the present invention, which shows that the separation of the movable contactor from the fixed contactors is completed and the opened circuit state is maintained.

As shown in FIG. 9, the rollers 151 are stopped by a holding groove surface 116 of the rotation shaft 110 at a final position of the clockwise rotating movable contactor 120 in an opened circuit state, thereby delaying a motion of the movable contactor 120 to return to the fixed contactors 20 and 30 or maintaining an opened circuit state of the movable contactor 120.

That is, when the movable contactor 120 reaches a position to be stopped by the stopper 49, the rollers 151 are stopped by the holding groove surface 116 of the rotation shaft 110. Accordingly, the movable contactor 120 maintains the opened circuit state by a current limiting operation unless a handle 11 of FIG. 1 is manually operated to apply an external force to the movable contactor 120 to be in contact with the fixed contactors 20 and 30.

As aforementioned, in the movable contactor assembly of a circuit breaker according to the first embodiment of the present invention, the slide pins for supporting both ends of the spring are slid along the cam surface of the rotation shaft having the first arc surface and the second arc surface and the outer circumferential surface. Accordingly, the elastic force applied to the movable contactor from the springs through the slide pins is converted into an opened circuit rotation moment for separating the movable contactor from the fixed contactors from a closed circuit rotation moment for returning the movable contactor to the fixed contactors, thereby accelerating the separation of the movable contactor from the fixed contactors and maximizing a current limiting function.

Also, at a final position of the movable contactor being rotated to be separated from the fixed contactors, the slide pins are stopped at the holding groove surface of the rotation shaft thereby delaying a motion of the movable contactor to return to the fixed contactors or maintaining the separated state of the movable contactor. Accordingly, the movable contactor is prevented from returning to the fixed contactors and the opened circuit state is maintained until arc is exhausted and a trip operation by the trip mechanism is performed. The movable contactor assembly for a circuit breaker according to the second embodiment of the present invention will be explained with reference to FIGS. 10 to 12.

As shown, a movable contactor assembly 200 for a circuit breaker according to the present invention comprises: a rotation shaft 210 having an opening 211 for allowing independent rotating a movable contactor 220 at the time of a current limiting operation and having a cam surface 213 on an outer circumferential surface thereof, for rotatably supporting the movable contactor 220; a movable contactor 220 rotatably disposed between both lateral surfaces of the rotation shaft 210, symmetrically having a pair of contacts 221 at both ends thereof and a pair of linear motion guiding grooves 222, and disposed to be rotated to a contact position to fixed contactors 20 and 30 or a separation position from the fixed contactors 20 and 30; a pair of slide pins 251 disposed across both lateral surfaces of the rotation shaft 210, linearly movable in the linear motion guiding grooves 222, contacting the cam surface 213 of the rotation shaft 210 under a state that the movable contactor 220 is in contact with the fixed contactors 20 and 30, for providing a pressure to the movable contactor 220 in a direction to accelerate a separation of the movable contactor 220 from the fixed contactors 20 and 30 with being separated from the cam surface 213 and thereby being slid along an outer circumferential surface of the rotation shaft 210 at the time of a current limiting operation that the movable contactor 220 is separated from the fixed contactors 20 and 30 and is rotated; and a spring 241 for providing an elastic force to the slide pins 251 so that a contact between the movable contactor 220 and the fixed contactors 20 and 30 can be maintained under a state that the movable contactor 220 is in contact with the fixed contactors 20 and 30, and for providing an elastic force to the slide pins 231 in a direction to accelerate a separation of the movable contactor 220 from the fixed contactors 20 and 30 at the time of a current limiting operation that the movable contactor 220 is separated from the fixed contactors 20 and 30 and is rotated.

Figure 10:
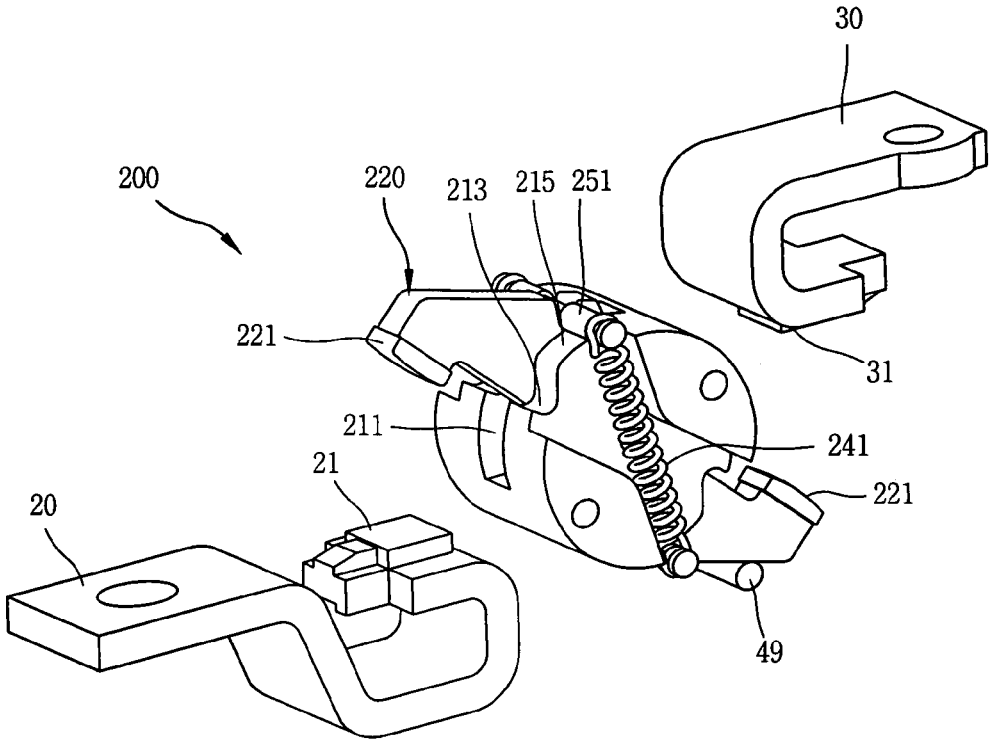
FIG. 10 is a perspective view showing an appearance of a movable contactor assembly for a circuit breaker according to a second embodiment of the present invention.

More specifically, the movable contactor 220 is disposed between a power side fixed contactor 20 (left side of FIG. 10) and a load side fixed contactor 30 (right side of FIG. 10). The fixed contactors 20 and 30 are current limiting type fixed contactors having end portions to which contacts 21 and 31 are attached, the end portions, respectively bent towards a power terminal to which a power side line is connected and a load terminal to which a load side line is connected. The movable contactor 220 has a symmetrical shape on the basis of the center in a longitudinal direction, and is provided with each contact 221 at both ends thereof thereby to be called as a double contacts type.

Both the openings 211 of the rotation shaft 210 in a diameter direction are opened as much as a preset angle so that both ends of the movable contactor 220 in a longitudinal direction can be freely rotated in the openings 211.

The rotation shaft 210 is a cylindrical shaft formed as two pieces of the shaft are combined to each other, and a pair of cam surfaces 223 of the rotation shaft 210 are symmetrical to each other on an outer circumferential surface of the rotation shaft 210.

The cam surface 213 on the outer circumferential surface of the rotation shaft 210 is a surface for mounting the slide pins 231 at a contact position of the movable contactor 220 to the fixed contactors 20 and 30, and includes a first arc surface (not shown) having a predetermined first radius formed from a center out of the rotation shaft 210, and a second arc surface (not shown) having a predetermined second radius formed from a center in the rotation shaft 210 and longer than the first radius. The cam surface 213 may be modified to include a plurality of arc surfaces having a plurality of radiuses formed from inner or external centers of the rotation shaft 210.

The slide pins 231 across both lateral surfaces of the rotation shaft 210 to be installed in the linear motion guiding grooves 223. At the time of a current limiting operation, the slide pins 231 pass through the cam surface 213 and then are slid along an outer circumferential surface 215 of the rotation shaft 210, and at the same time, are performed a linearly motion in the linear motion guiding grooves 223 of the movable contactor 220.

A depth of the linear motion guiding groove 223 is formed to be deeper than or equal to a depth d of the cam surface 213 in order to prevent the slide pins 231 from being separated from the linear motion guiding grooves 223.

Preferably, a pair of rollers 251 are rotatably disposed at both ends of the slide pin 231 in a longitudinal direction in order to decrease a frictional force between the slide pin 231 and the rotation shaft 210.

The rollers 251 are stopped at the first circular surface of the cam surface 213 when the movable contactor 220 is in contact with the fixed contactors 20 and 30. Also, at the time of a current limiting operation that the movable contactor 220 is separated from the fixed contactors 20 and 30 to be rotated, the rollers 251 pass through the second circular surface of the cam surface 213 to be slid along the outer circumferential surface 215 of the rotation shaft 210, thereby minimizing a friction between the slide pins 231 and the rotation shaft 210 and performing a smooth current limiting operation.

One spring 241 is installed at each lateral surface of the movable contactor 220, and both ends of the spring 241 are supported by the slide pins 231.

The rotation shaft 210 is provided with a pair of holding groove surfaces 216. The holding groove surfaces 216 delay a motion of the movable contactor 220 to return to a contact position to the fixed contactors 20 and 30 by receiving the slide pins on the outer circumferential surface of the rotation shaft 210 at a final position of the rotating movable contactor 220, or maintains a separated state of the movable contactor 220 from the fixed contactors 20 and 30 at the time of a current limiting operation that the movable contactor 220 is separated from the fixed contactors 20 and 30 to be rotated.

Under a state that the movable contactor 220 is in contact with the fixed contactors 20 and 30, that is, a closed circuit state, the rollers 251 are in contact with the first arc surface having the center out of the rotation shaft 210. Also, at the time of a current limiting operation that the movable contactor 220 is separated from the fixed contactors 20 and 30 by an electromagnetic repulsive force to be rotated due to the large current on a circuit, that is, when the contacts 221, 21, and 31 are separated from each other, the rollers 251 are sequentially moved to the first arc surface and to the second arc surface having a second radius formed from the center in the rotation shaft 210 and longer than the first radius of the first arc surface, and roll on the outer circumferential surface 215 of the rotation shaft 210. The spring 241 provides an elastic force to the movable contactor 220 as a rotation moment through the slide pins 231 so that the separation of the movable contactor 220 from the fixed contactors 20 and 30 can be accelerated.

An unexplained reference numeral 49 of FIG. 10 denotes a stopper, a limit pin for limiting a rotation position of the movable contactor 220 into a preset position when the movable contactor 220 is separated from the fixed contactors 20 and 30.

The movable contactor assembly of one phase was disclosed for the convenience of explanation. However, in case of a multiple-phase movable contactor assembly, the rotation shaft 210 can have a bar shape long connected to a rotation shaft of another phase and be connected to the switching mechanism 12 of FIG. 1, so that rotation shafts of several phases can be simultaneously rotated by the switching mechanism 12.

Figure 11:
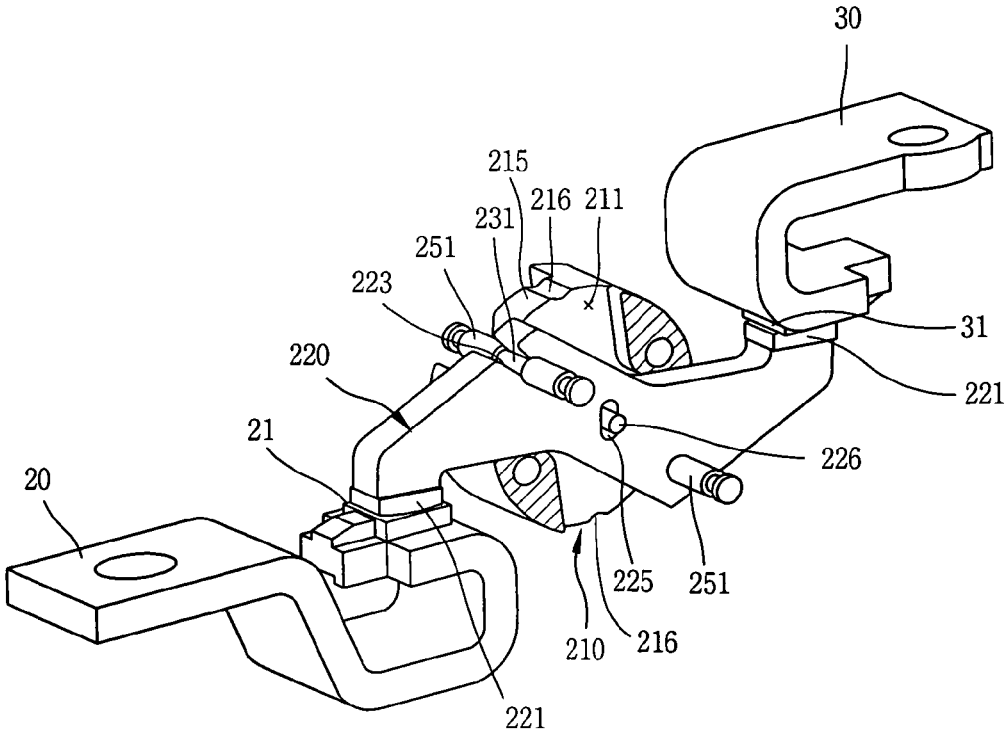
FIG. 11 is a perspective view of the movable contactor assembly for a circuit breaker according to the second embodiment of the present invention, which shows a state that contacts are in contact with each other (a closed circuit state)

The movable contactor 220 of the aforementioned embodiment is supported by a self centering by the spring 241 and the pins 231 for supporting both ends of the spring 241 without a center axis of the rotation shaft 210. However, in the present invention, as shown in FIG. 11, the movable contactor 220 is provided with a vertical long hole 225 for passing a rotation axis 226 at the center in the longitudinal direction, so that both ends of the movable contactor 220 can be supported by the rotation shaft 210. Both ends of the rotation axis 226 are inserted into rotation axis holes 260*a* formed at the rotation shaft 210 to be supported by the rotation shaft 210. The length of the rotation axis 226 is preset so that the rotation axis 226 can not be protruded outside both outer wall surfaces 212 of the rotation shaft 210. Due to the vertical long hole 225 formed at the center of the movable contactor 220 in the longitudinal direction for passing the rotation axis 226, a contact pressure between the movable contact 221 and the fixing contacts 21 and 31 can be uniformly maintained even if the upper and lower fixed contactors 20 and 30 are not precisely symmetrical to each other on the basis of the movable contactor 220 due to an uneven abrasion of the movable contact 221 and the fixed contacts 21 and 31.

Figure 12:
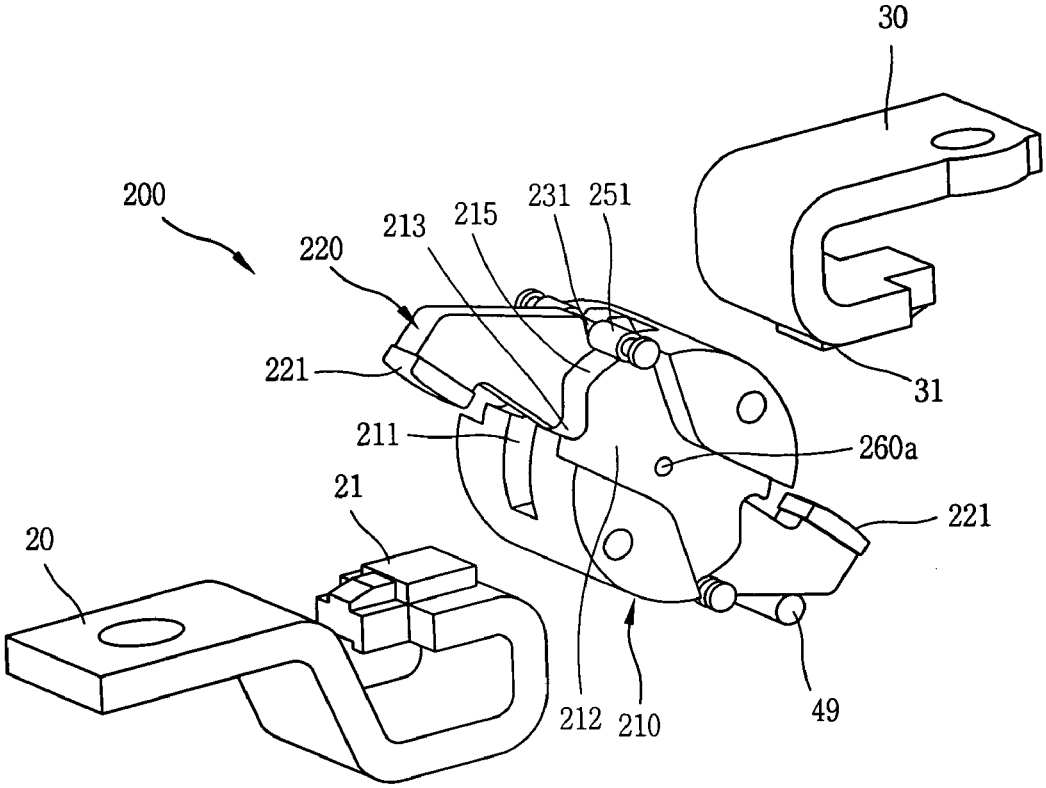
FIG. 12 is a perspective view of the movable contactor assembly for a circuit breaker according to the second embodiment of the present invention, which shows a state that the contacts are separated from each other (an opened circuit state)

In the preferred embodiment shown in FIG. 11, at the time of a current limiting operation that the movable contactor 220 is separated from the fixed contactors 20 and 30, the spring 241 is installed on both outer wall surfaces 212 of the rotation shaft 210 that is not in contact with the rotation axis 226 as shown in FIGS. 10 and 12 thereby not to generate an interference between the spring 241 and the rotation axis 226.

An operation of the movable contactor assembly of a circuit breaker according to the second embodiment of the present invention will be explained as follows with reference to FIGS. 13 to 15.

Figure 13:
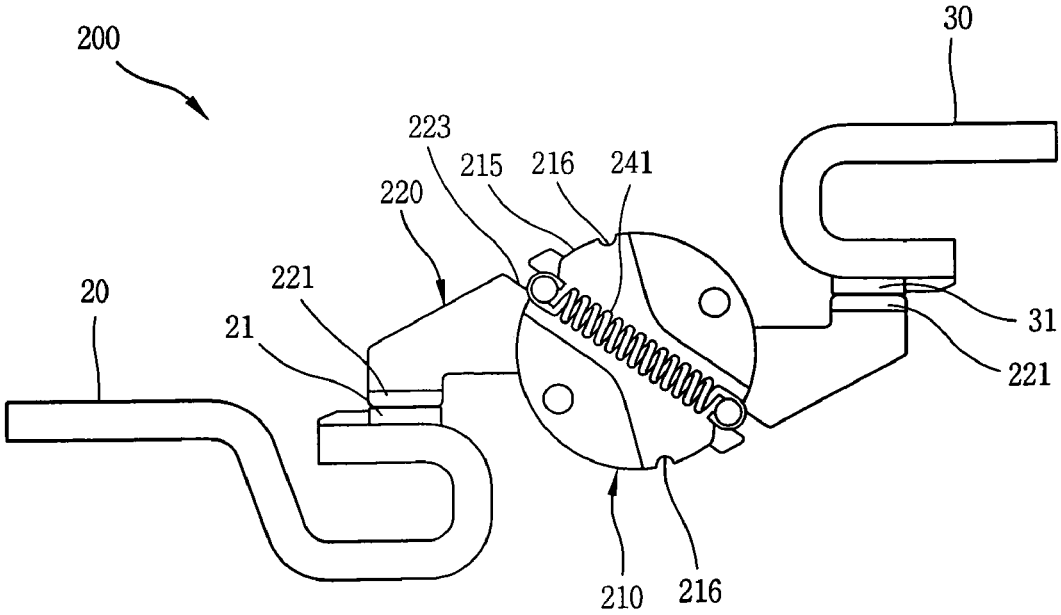
FIG. 13 is a front view of the movable contactor assembly for a circuit breaker according to the second embodiment of the present invention, which shows a state that the contacts are in contact with each other (a closed circuit state)

FIG. 13 is a frontal view of the movable contactor assembly of a circuit breaker according to the second embodiment of the present invention, which shows a state that the contacts are in contact with each other (a closed circuit state).

As shown in FIG. 13, under the state that the contacts are in contact with each other, the slide pins 231 connected to the spring 241 generate a counterclockwise rotation moment, that is, a force to rotate the movable contactor 220 in a counterclockwise direction due to an initial elastic force of the spring 241. Accordingly, each contact 221 of the movable contactor 220 is in contact with the contacts 21 and 31 of the fixed contactors 20 and 30.

Each roller 151 of the slide pins 231 is in contact with the first circular surface of the cam surface 213 of the rotation member 210. Under the closed circuit state, a current on the circuit is introduced into the contact 21 of the power side fixed contactor 20, passes through each contact 221 of the movable contactor 220, and flows to a load terminal (not shown) via the contact 31 of the load side fixed contactor 30.

Figure 14:
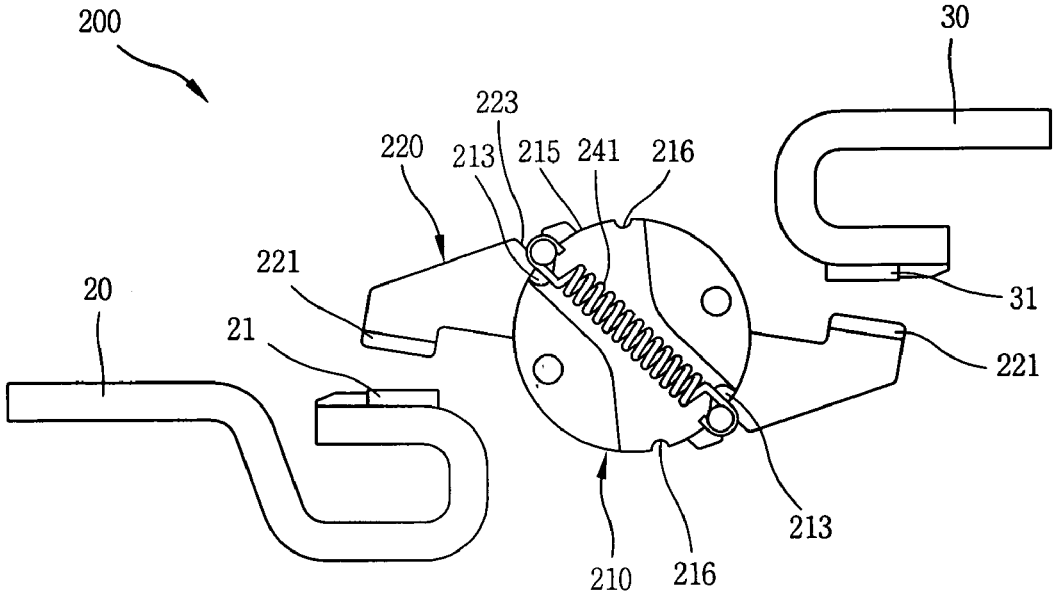
FIG. 14 is a front view of the movable contactor assembly for a circuit breaker according to the second embodiment of the present invention, which shows a state that the contacts are being separated from each other (an opened circuit state)

FIG. 14 is a frontal view of the movable contactor assembly of a circuit breaker according to the second embodiment of the present invention, which shows a state that the contacts are being in contact with each other (an opened circuit state).

As shown in FIG. 14, when the large current flows on a circuit due to a short-circuit or a ground fault, an electromagnetic repulsive force is generated between each contact 221 of the movable contactor 220 and the contacts 21 and 31 of the fixed contactors 20 and 30. Accordingly, the movable contactor 220 is rotated in a direction to be separated from the fixed contactors 20 and 30, that is, the clockwise direction. The electromagnetic repulsive force is the force much greater than the rotation moment generated by the spring 241 for counterclockwise rotating the movable contactor 220, so that the movable contactor 220 is clockwise rotated. The rollers 251 disposed at both ends of each slide pin 231 pull the spring 241, and at the same time, roll on the cam surface 213 of the rotation shaft 210 and then are moved along the outer circumferential surface 215 of the rotation shaft 210. That is, as the movable contactor 220 is clockwise rotated, the rollers 251 disposed at both ends of each slide pin 231 pull the spring 241, and at the same time, sequentially pass the first arc surface having the center out of the rotation shaft 210 and a starting point (so called as a dead point) of the second circular surface having the center in the rotation shaft 210. While the rollers 251 pass through the dead point, the elastic force of the spring 241 is converted into an opened circuit rotation moment for accelerating a separation of the movable contactor 210 from the fixed contactors 20 and 30 from a closed circuit rotation moment for returning the movable contactor 220 to the fixed contactors 20 and 30.

The slide pins 231 are linearly moved in the linear motion guiding grooves 223 of the movable contactor 220, and at the same time, are slid along the cam surface 213 of the rotation shaft 210 and the outer circumferential surface 215. However, since the depth of each linear motion guiding groove 223 is deeper than or equal to the depth of the first circular surface, the deepest surface among the cam surface 213, the slide pins 231 are not separated from the linear motion guiding groove 223.

Then, each roller 251 installed at the slide pins 231 is separated from the cam surface 213 of the rotation shaft 210 and rolls on the outer circumferential surface 215 by the movable contactor 220 being clockwise rotated by the electromagnetic repulsive force. The elastic-force applied to the movable contactor 220 from the spring 241 through the slide pins 231 is converted into an opened circuit rotation moment for separating the movable contactor 220 from the fixed contactors 20 and 30 from a closed circuit rotation moment for returning the movable contactor 220 to the fixed contactors 20 and 30 (a counterclockwise direction in drawing), thereby accelerating a separation of the movable contactor 220 from the fixed contactors 20 and 30.

At the time of a current limiting operation by the movable contactor assembly according to the present invention, the separation of the movable contactor from the fixed contactors is accelerated thereby to improve a current limiting function of the circuit breaker.

Figure 15:
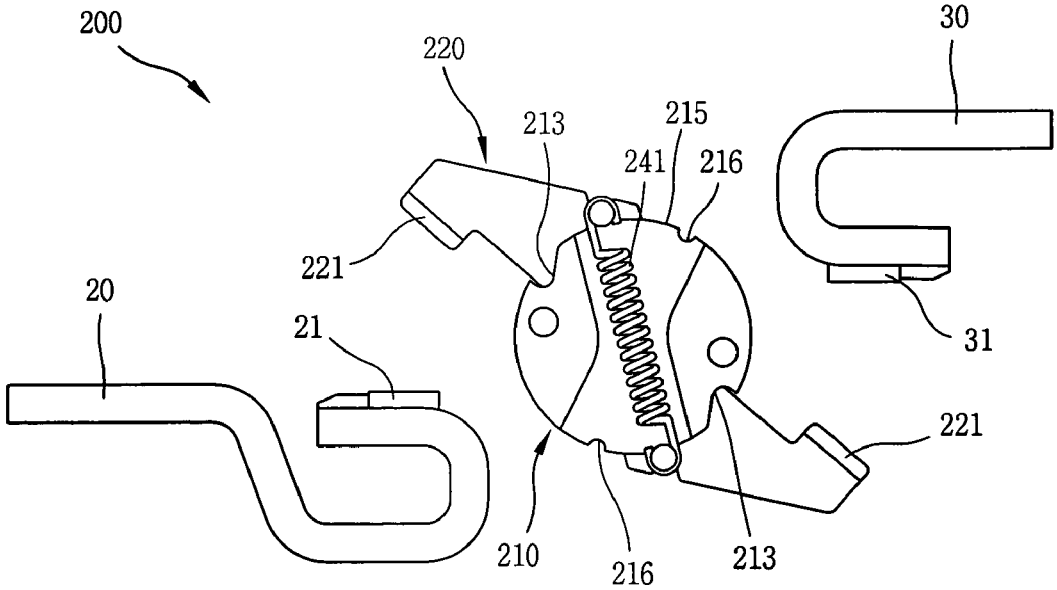
FIG. 15 is a front view of the movable contactor assembly for a circuit breaker according to the second embodiment of the present invention, which shows that the separation of the movable contactor from the fixed contactors is completed and the opened circuit state is maintained.

FIG. 15 is a frontal view of the movable contactor assembly of a circuit breaker according to the second embodiment of the present invention, which shows a state that the separation of the movable contactor from the fixed contactors is completed and the opened circuit state is maintained.

As shown in FIG. 15, the rollers 251 are stopped by a holding groove surface 216 of the rotation shaft 210 at a final position of the clockwise rotating movable contactor 220 in an opened circuit state, thereby delaying a motion of the movable contactor 220 to return to the fixed contactors 20 and 30 and maintaining the separated state of the movable contactor 220 from the fixed contactors 20 and 30.

That is, when the movable contactor 220 reaches a position to be stopped by the stopper 49, the rollers 251 are stopped by the holding groove surface 216 of the rotation shaft 210. Accordingly, the movable contactor 220 maintains the separated state from the fixed contactors 20 and 30 by a current limiting operation unless a handle 11 of FIG. 1 is manually operated to apply an external force to the movable contactor 220 to be in contact with the fixed contactors 20 and 30.

As aforementioned, in the movable contactor assembly of a circuit breaker according to the second embodiment of the present invention, the slide pins for supporting both ends of the spring are slid along the cam surface of the rotation shaft having the first arc surface and the second arc surface and the outer circumferential surface. Accordingly, the elastic force applied to the movable contactor from the spring through the slide pins is converted into an opened circuit rotation moment for separating the movable contactor from the fixed contactors from a closed circuit rotation moment for returning the movable contactor to the fixed contactors, thereby accelerating the separation of the movable contactor from the fixed contactors and maximizing a current limiting function.

Also, at a final position of the movable contactor being clockwise rotated to be separated from the fixed contactors, the slide pin is stopped at the holding groove surface of the rotation shaft thereby delaying a motion of the movable contactor to return to the fixed contactors or maintaining the separated state of the movable contactor. Accordingly, the movable contactor is prevented from returning to the fixed contactors and the opened circuit state is maintained until arc is exhausted and a trip operation is performed by the trip mechanism.

Also, in the second embodiment of the present invention, the spring is easily mounted by supporting both ends thereof at the slide pins from outside of the rotation shaft, thereby simplifying the assembly.

Additionally, since the rotation axis hole for passing the rotation axis is formed at the center of the movable contactor as a vertical long hole, a contact pressure between the movable contactor point and the fixing contacts can be uniformly maintained even if the upper and lower fixed contactors are not symmetrically installed or even if the upper and lower fixed contactors are not precisely symmetrical to each other on the basis of the movable contactor due to an uneven abrasion of the movable contact and the fixed contacts.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A movable contactor assembly for a circuit breaker comprising:

a rotation shaft provided with an opening for allowing independent rotating of a movable contactor at the time of a current limiting operation and having a cam surface on an outer circumferential surface thereof, for rotatably supporting the movable contactor;

the movable contactor rotatably supported by the rotation shaft, symmetrically having a pair of contacts at both ends thereof and a pair of linear motion guiding grooves, and rotatable to a contacted position to fixed contactors or a separated position from the fixed contactors;

a pair of slide pins disposed across both lateral surfaces of the rotation shaft, linearly movable in the linear motion guiding grooves, and maintaining a contact state to the cam surface of the rotation shaft under a state that the movable contactor is in contact with the fixed contactors, for providing a pressure to the movable contactor in a direction to accelerate a separation of the movable contactor from the fixed contactors with being separated from the cam surface and thereby being slid along an outer circumferential surface of the rotation shaft at the time of a current limiting operation that the movable contactor is separated from the fixed contactors to be rotated; and a spring for providing an elastic force to the slide pins so that a contact between the movable contactor and the fixed contactors can be maintained under a state that the movable contactor is in contact with the fixed contactors, and for providing an elastic force to the slide pins in a direction to accelerate a separation of the movable contactor from the fixed contactors at the time of a current limiting operation that the movable contactor is separated and rotated from the fixed contactors in contrast to the static rotation shaft.

2. The movable contactor assembly of claim 1, wherein the rotation shaft further comprises a holding groove surface for delaying a motion of the movable contactor to return to the contacted position to the fixed contactors by receiving the slide pins on the outer circumferential surface of the rotation shaft at a final position of the rotating movable contactor or for maintaining the separated state of the movable contactor from the fixed contactors at the time of a current limiting operation that the movable contactor is separated from the fixed contactors to be rotated.

3. The movable contactor assembly of claim 1, wherein a depth of the linear motion guiding groove is formed to be deeper than or equal to a depth of the cam surface in order to prevent the slide pins from being separated from the linear motion guiding grooves.

4. The movable contactor assembly of claim 1, further comprising a roller rotatably disposed each of the slide pins for decreasing a frictional force between the slide pins and the rotation shaft.

5. The movable contactor assembly of claim 1, wherein two slide pins are disposed to be symmetrical to each other, two fixed pins are symmetrically fixed to the movable contactor, two springs are installed at each lateral surface of the movable contactor, and the two springs are symmetrically installed so that one ends thereof can be supported by the slide pins and the other ends thereof can be supported by the fixed pins.

6. The movable contactor assembly of claim 1, wherein one spring is installed at each lateral surface of the movable contactor, and both ends of the spring are supported by the slide pins.

7. The movable contactor assembly of claim 1, wherein the movable contactor is provided with a long hole for inserting a rotation axis thereof at a center thereof, and both ends of the rotation axis that has been inserted into the long hole are inserted into rotation axis holes formed at the rotation shaft to be supported by the rotation shaft.

* * * * *

UNITED STATES PATENT AND TRADEMARK OFFICE

CERTIFICATE OF CORRECTION

PATENT NO. : 7,005,594 B2 
APPLICATION NO. : 11/103443
DATED : February 28, 2006
INVENTOR(S) : Y.G. Kim It is certified that error appears in the above-identified patent and that said Letters Patent is hereby corrected as shown below:

At column 16, line 2 (claim 4, line 2) of the printed patent, after "disposed" insert --at--.

Signed and Sealed this

Seventh Day of November, 2006

JON W. DUDAS
*Director of the United States Patent and Trademark Office*